US006955229B1

(12) United States Patent
Hoffart

(10) Patent No.: US 6,955,229 B1
(45) Date of Patent: Oct. 18, 2005

(54) IMPLEMENT PITCH-YAW SYSTEM

(76) Inventor: Ronald J. Hoffart, 755 2nd Ave. NW., West Fargo, ND (US) 58078

( * ) Notice: Subject to any disclaimer, the term of this patent is extended or adjusted under 35 U.S.C. 154(b) by 17 days.

(21) Appl. No.: 10/622,964

(22) Filed: Jul. 18, 2003

(51) Int. Cl.[7] ..... E02F 3/76
(52) U.S. Cl. ..... 172/811; 172/789; 172/795
(58) Field of Search ..... 172/810, 811, 818, 172/819, 820, 821, 822, 823, 824, 826, 828, 172/789, 791, 795, 796, 797; 37/279, 283, 37/381

(56) References Cited

U.S. PATENT DOCUMENTS

| | | | | | |
|---|---|---|---|---|---|
| 2,059,431 | A | * | 11/1936 | Barrett et al. | 172/823 |
| 2,792,650 | A | * | 5/1957 | Kenyon | 37/234 |
| 3,425,715 | A | | 2/1969 | Weitz | 280/479 |
| 3,631,930 | A | | 1/1972 | Peterson | 172/804 |
| 3,655,000 | A | * | 4/1972 | Winkler | 172/821 |
| 3,674,096 | A | * | 7/1972 | Berg | 172/821 |
| 3,690,386 | A | | 9/1972 | Magee | 172/804 |
| 3,698,490 | A | | 10/1972 | King | 172/803 |
| 3,755,930 | A | | 9/1973 | Brandt et al. | 37/10 |
| 3,913,684 | A | * | 10/1975 | Casey et al. | 172/821 |
| 3,941,195 | A | | 3/1976 | Stedman | 172/801 |
| 4,019,588 | A | | 4/1977 | Casey | 172/804 |
| 4,076,080 | A | * | 2/1978 | Anderson | 172/821 |
| 4,161,987 | A | * | 7/1979 | Tolmer | 172/791 |
| 4,221,282 | A | | 9/1980 | Wampfler | 191/68 |
| 4,241,794 | A | * | 12/1980 | Halterman, Jr. | 172/818 |
| 4,244,429 | A | | 1/1981 | Nissen | 172/804 |
| 4,270,617 | A | * | 6/1981 | Cantarella et al. | 172/821 |
| 4,360,216 | A | | 11/1982 | Wiemers | 280/479 |
| 4,405,019 | A | | 9/1983 | Frisbee | 172/816 |
| RE31,642 | E | * | 8/1984 | Asal et al. | 172/821 |
| 4,463,507 | A | * | 8/1984 | Gaub | 37/404 |
| 4,828,044 | A | | 5/1989 | Horsch et al. | 172/821 |
| 4,962,598 | A | * | 10/1990 | Woolhiser et al. | 37/231 |
| 5,060,463 | A | | 10/1991 | Jones | 56/15.9 |
| 5,209,307 | A | | 5/1993 | Hotte | 172/445.2 |
| 5,263,810 | A | | 11/1993 | Takekata et al. | 414/723 |
| 5,419,673 | A | | 5/1995 | Merhar | 414/723 |
| 5,447,204 | A | * | 9/1995 | Asal et al. | 172/821 |
| 5,634,523 | A | | 6/1997 | Kobayashi et al. | 172/818 |
| 5,692,855 | A | | 12/1997 | Burton | 403/325 |
| 6,041,870 | A | | 3/2000 | Zimmerman et al. | 172/811 |
| 6,059,048 | A | | 5/2000 | Subrt | 172/821 |
| 6,105,682 | A | | 8/2000 | Recker et al. | 172/811 |
| 6,112,828 | A | | 9/2000 | Leal | 172/684.5 |
| 6,247,540 | B1 | * | 6/2001 | Clemen et al. | 172/818 |
| 6,273,198 | B1 | * | 8/2001 | Bauer et al. | 172/825 |
| 6,408,548 | B1 | | 6/2002 | Altheide | 37/268 |
| 2003/0140529 | A1 | | 7/2003 | Bloxdorft et al. | 37/266 |
| 2003/0217852 | A1 | | 11/2003 | Bernhardt et al. | 172/200 |

OTHER PUBLICATIONS

Pictures of Unknown Brand of Belly Blade, Taken 2003.

* cited by examiner

*Primary Examiner*—Robert E. Pezzuto
*Assistant Examiner*—Nathan Mammen
(74) *Attorney, Agent, or Firm*—Michael S. Neustel

(57) ABSTRACT

An implement pitch-yaw system for effectively and efficiently controlling the pitch of an implement. The implement pitch-yaw system includes a first yaw actuator and a second yaw actuator attached between an implement structure pivotally attached to a support structure and a connecting member slidably attached to the support structure, and a pitch actuator attached between the connecting member and the support structure. The extension/retraction of the pitch actuator moves the yaw actuators accordingly thereby creating the desired pitch movement for the implement structure.

20 Claims, 6 Drawing Sheets

IMPLEMENT PITCH-YAW SYSTEM

CROSS REFERENCE TO RELATED APPLICATIONS

Two other utility patent applications are being filed with the USPTO simultaneously with this application identified by Ser. No. 10/622,961 and Ser. No. 10/622,959.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to tractor implement mounting systems and more specifically it relates to an implement pitch-yaw system for effectively and efficiently controlling the pitch of an implement.

2. Description of the Related Art

Implement mounting structures have been in use for years. Conventional implement mounting structures, such as a front-end loader, allow for only lift and pitch movements. A bucket or other implement is pivotally attached to the distal ends of loader arms with at least one actuator directly connected between the loader arms and an upper portion of the bucket for facilitating the pitch movements of the bucket. However, these implement mounting structures are significantly limited in that they only provide lift and pitch movements for the implement.

Improvements have been made in the art so that additional movements such as roll and yaw may be accomplished for the implement utilizing additional actuators and complex structures. The roll movement is typically accomplished utilizing a pair of vertically orientated actuators attached to the mounting structure to roll the implement. The yaw movement is typically accomplished utilizing a pair of horizontally orientated actuators attached to the implement and the mounting structure.

U.S. Pat. No. 6,059,048 illustrates an implement mounting arrangement having "all way" operability where a pair of horizontal actuators are utilized to control both the pitch and yaw of the implement. However, for the technology to work properly in controlling the horizontal actuators of the '048 patent, a complex hydraulic control system is required to effectively control the implement.

While these devices may be suitable for the particular purpose to which they address, they are not as suitable for effectively and efficiently controlling the pitch of an implement. Conventional implement mounting systems that provide "all way" operability are complex, bulky and difficult to utilize in an accurate manner.

In these respects, the implement pitch-yaw system according to the present invention substantially departs from the conventional concepts and designs of the prior art, and in so doing provides an apparatus primarily developed for the purpose of effectively and efficiently controlling the pitch of an implement.

BRIEF SUMMARY OF THE INVENTION

In view of the foregoing disadvantages inherent in the known types of implement support systems now present in the prior art, the present invention provides a new implement pitch-yaw system construction wherein the same can be utilized for effectively and efficiently controlling the pitch of an implement.

The general purpose of the present invention, which will be described subsequently in greater detail, is to provide a new implement pitch-yaw system that has many of the advantages of the implement support systems mentioned heretofore and many novel features that result in a new implement pitch-yaw system which is not anticipated, rendered obvious, suggested, or even implied by any of the prior art implement support systems, either alone or in any combination thereof.

To attain this, the present invention generally comprises a first yaw actuator and a second yaw actuator attached between an implement pivotally attached to a support structure and a connecting member slidably attached to the support structure, and a pitch actuator attached between the connecting member and the support structure. The extension/retraction of the pitch actuator moves the yaw actuators accordingly thereby creating the desired pitch movement for the implement.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an implement pitch-yaw system that will overcome the shortcomings of the prior art devices.

A second object is to provide an implement pitch-yaw system for effectively and efficiently controlling the pitch of an implement.

Another object is to provide an implement pitch-yaw system that provides a simple solution for providing both pitch and yaw to an implement.

An additional object is to provide an implement pitch-yaw system that accurately controls the pitch-yaw of an implement.

A further object is to provide an implement pitch-yaw system that does not require complex hydraulic control systems to control the movement of horizontal actuators.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
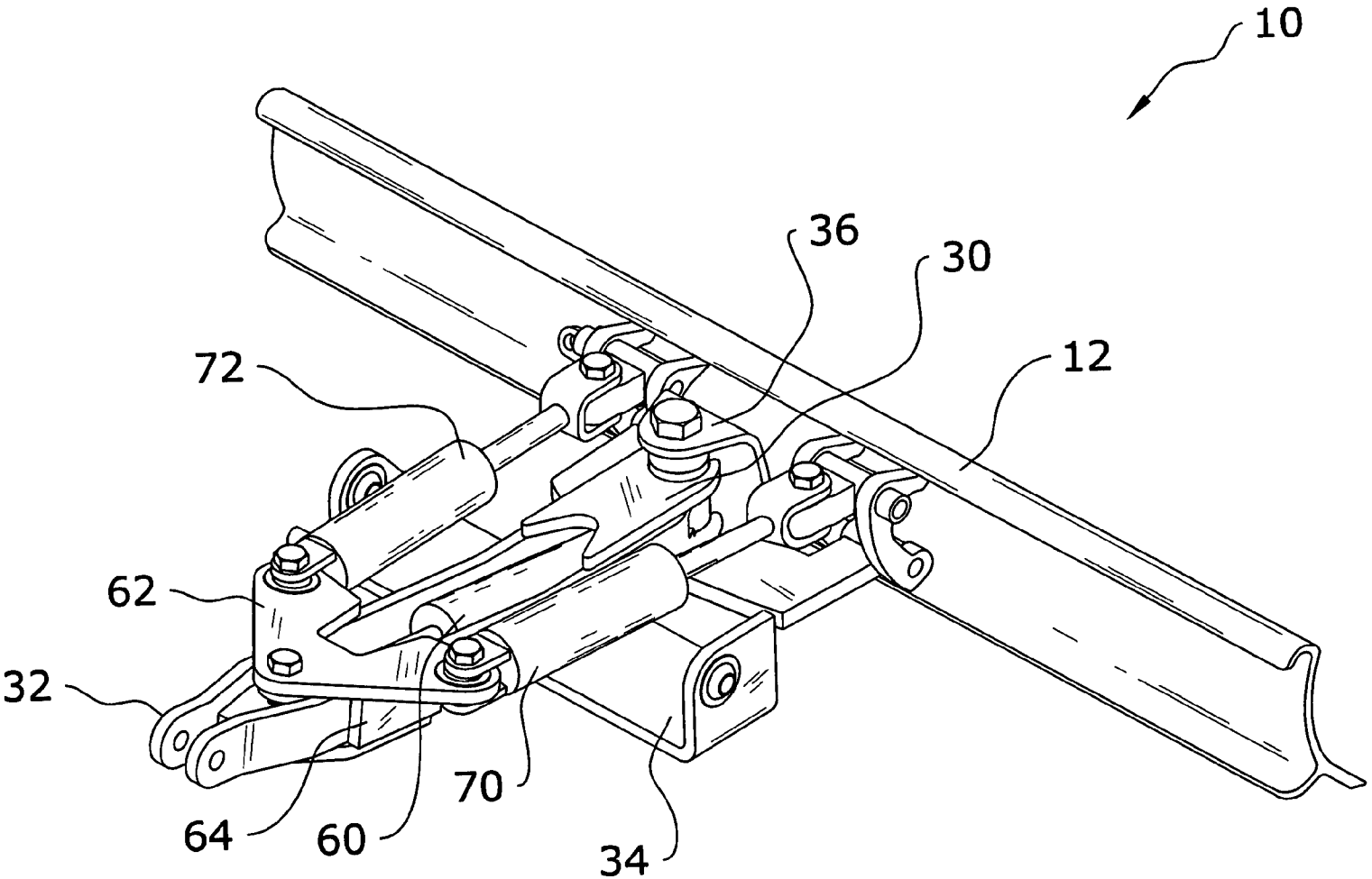
FIG. 1 is an upper perspective view of the present invention.

Turning now descriptively to the drawings, in which similar reference characters denote similar elements throughout the several views, FIGS. 1 through 9 illustrate an implement pitch-yaw system 10, which comprises a first yaw actuator 70 and a second yaw actuator 70 attached between an implement pivotally attached to a support structure 30 and a connecting member 62 slidably attached to the support structure 30, and a pitch actuator 60 attached between the connecting member 62 and the support structure 30. The extension/retraction of the pitch actuator 60 moves the yaw actuators accordingly thereby creating the desired pitch movement for the implement.

B. Support Structure

As shown in FIGS. 1 through 7 of the drawings, the support structure 30 is comprised of an elongate structure. Various other structures may be utilized to construct the support structure 30 other than shown in the drawings. The support structure 30 may be attached directly to a vehicle (e.g. tractor, etc.), to a frame structure or by other means.

A cuff structure 32 at the distal end of the support structure 30 may be utilized to attach the support structure 30 to a pivot joint such as but not limited to a ball-and-socket joint. A cross member 34 is preferably attached to the support structure 30 for receiving vertical actuators for allowing manipulation of the lift and roll of the implement structure 12.

As shown in FIGS. 1 through 7 of the drawings, the support structure 30 preferably has a cavity for receiving the pitch actuator 60 within. However, the pitch actuator 60 may be positioned external of the support structure 30.

C. Implement Structure

The implement structure 12 is pivotally attached to the support structure 30 by at least one front joint 36 for preferably allowing both pitch and yaw movements to occur. The implement structure 12 may be any type of an implement such as but not limited to a blade, a plow, a bucket, a brush or other device. In addition, the implement structure 12 may be any type of an attachment structure for removably receiving an implement. 1.

D. Connecting Member

Figure 3:
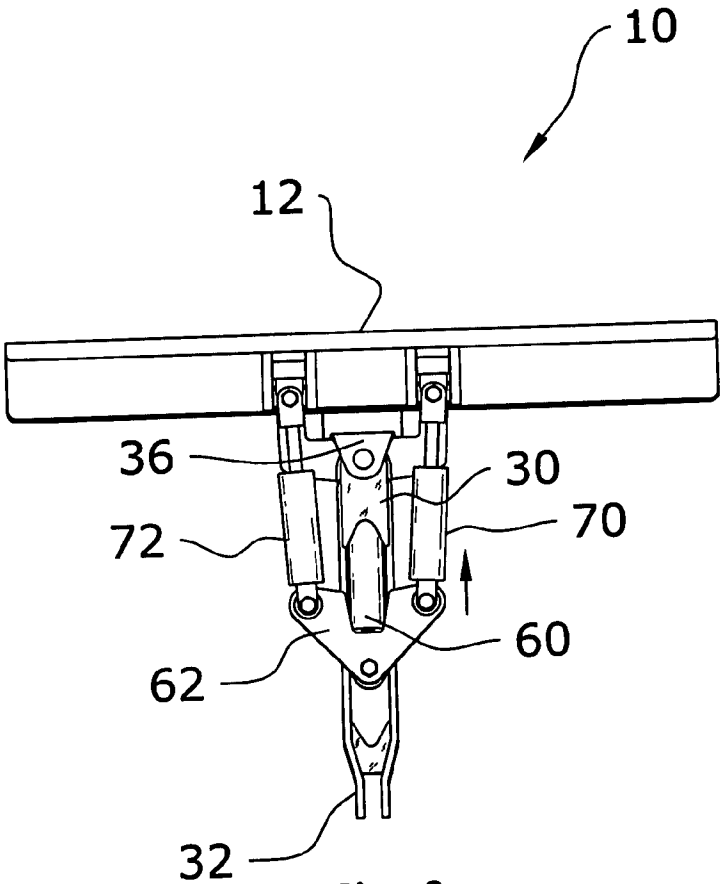
FIG. 3 is a top view of the present invention with the implement pitch forward.
Figure 4:
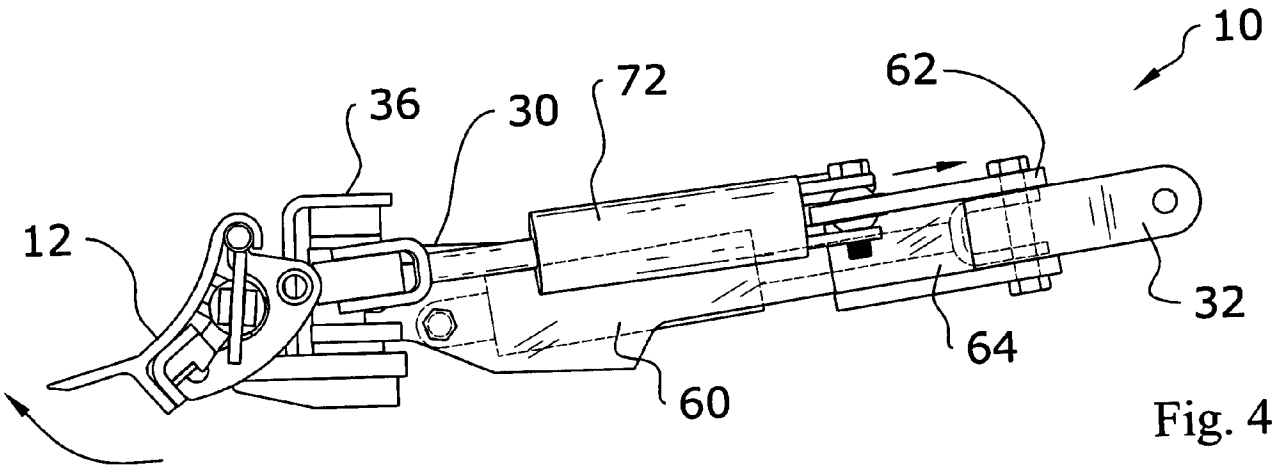
FIG. 4 is a side view of the present invention with the implement pitch rearward.
Figure 5:
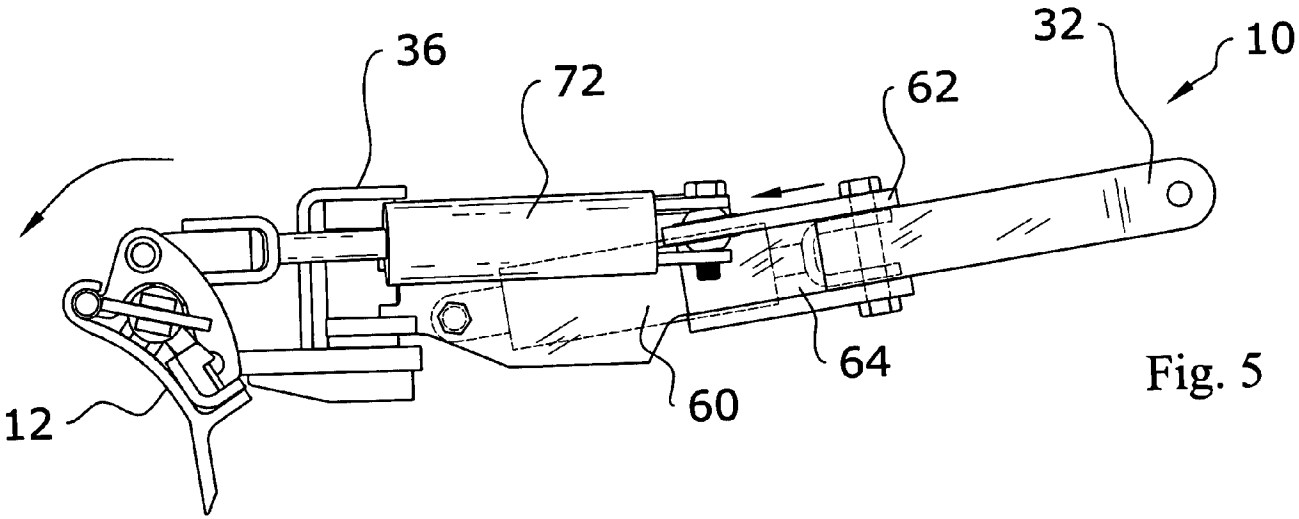
FIG. 5 is a side view of the present invention with the implement pitch forward.

The connecting member 62 is slidably attached to the support structure 30 as shown in FIGS. 1 through 7 of the drawings. A slide structure 64 is preferably slidably positioned about the support structure 30 with the connecting member 62 attached to the slide structure 64 as best shown in FIGS. 4 and 5 of the drawings.

Figure 7:
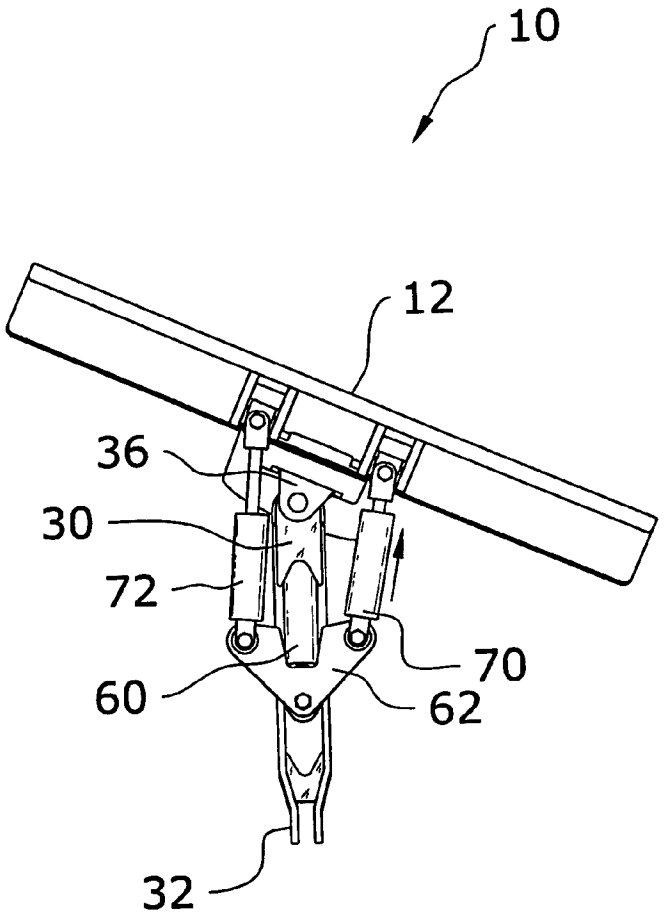
FIG. 7 is a top view of the present invention with the implement pitch rearward with the yaw at an angle.
Figure 6:
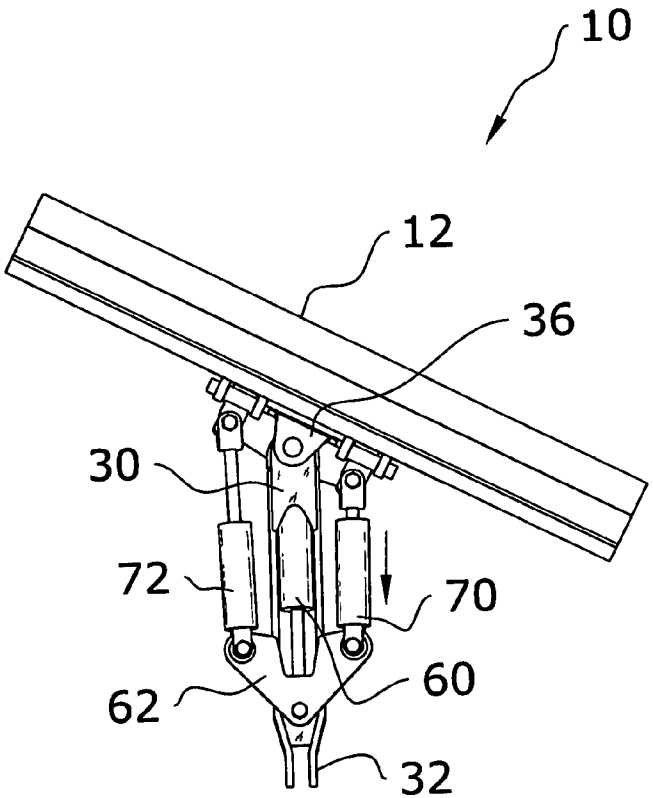
FIG. 6 is a top view of the present invention with the implement pitch rearward with the yaw at an angle.

As shown in FIGS. 6 and 7 of the drawings, the connecting member 62 preferably has a winged structure. The first yaw actuator 70 and the second yaw actuator 70 are attached to opposing portions of the connecting member 62 as further shown in FIGS. 6 and 7 of the drawings. In addition, the connecting member 62 preferably is centered along a longitudinal axis of the support structure 30 and the movement of the connecting member 62 preferably is parallel to the longitudinal axis of the support structure 30.

E. Yaw Actuators

As shown in FIGS. 1 through 7 of the drawings, a first yaw actuator 70 and a second yaw actuator 70 are attached between the implement structure 12 and the connecting member 62. The first yaw actuator 70 and the second actuator are for controlling the yaw position of the implement structure 12.

F. Pitch Actuator

The pitch actuator 60 is attached between the connecting member 62 and the support structure 30 as best shown in FIGS. 1 through 7 of the drawings. The pitch actuator 60 preferably is positioned within the support structure 30 as shown in FIGS. 4 and 5 of the drawings, however the pitch actuator 60 may be positioned external of the support structure 30.

The extension/retraction of the pitch actuator 60 causes the first yaw actuator 70 and the second yaw actuator 70 to extend/retract accordingly in a relatively horizontal manner as shown in FIGS. 6 and 7 of the drawings. The actuators 60, 70, 72 may be comprised of various actuator structures such as but not limited hydraulic, electric and the like.

G. Control System

Figure 9:
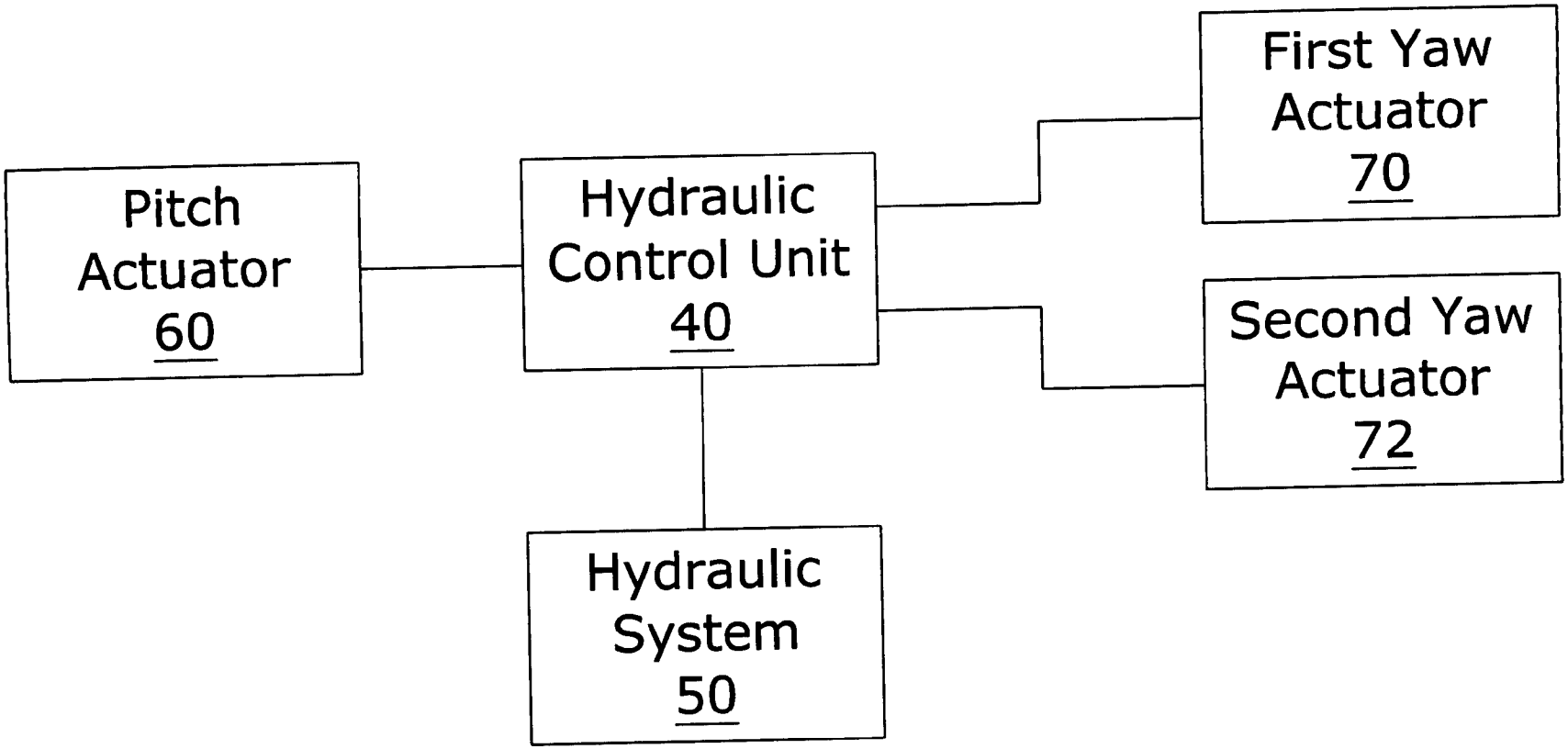
FIG. 9 is a block diagram illustrating the hydraulic connections within the present invention.

A control unit 40 is in communication with the first yaw actuator 70, the second yaw actuator 70 and the pitch actuator 60 for controlling the same as shown in FIG. 9 of the drawings. The control unit 40 determines which actuators 60, 70, 72 should be extended/retracted according to the controls manipulated by the operator of the vehicle. The control unit 40 is a valve unit when utilized with a hydraulic system 50 for controlling the flow of hydraulic fluid to the actuators.

H. Operation

Figure 8:
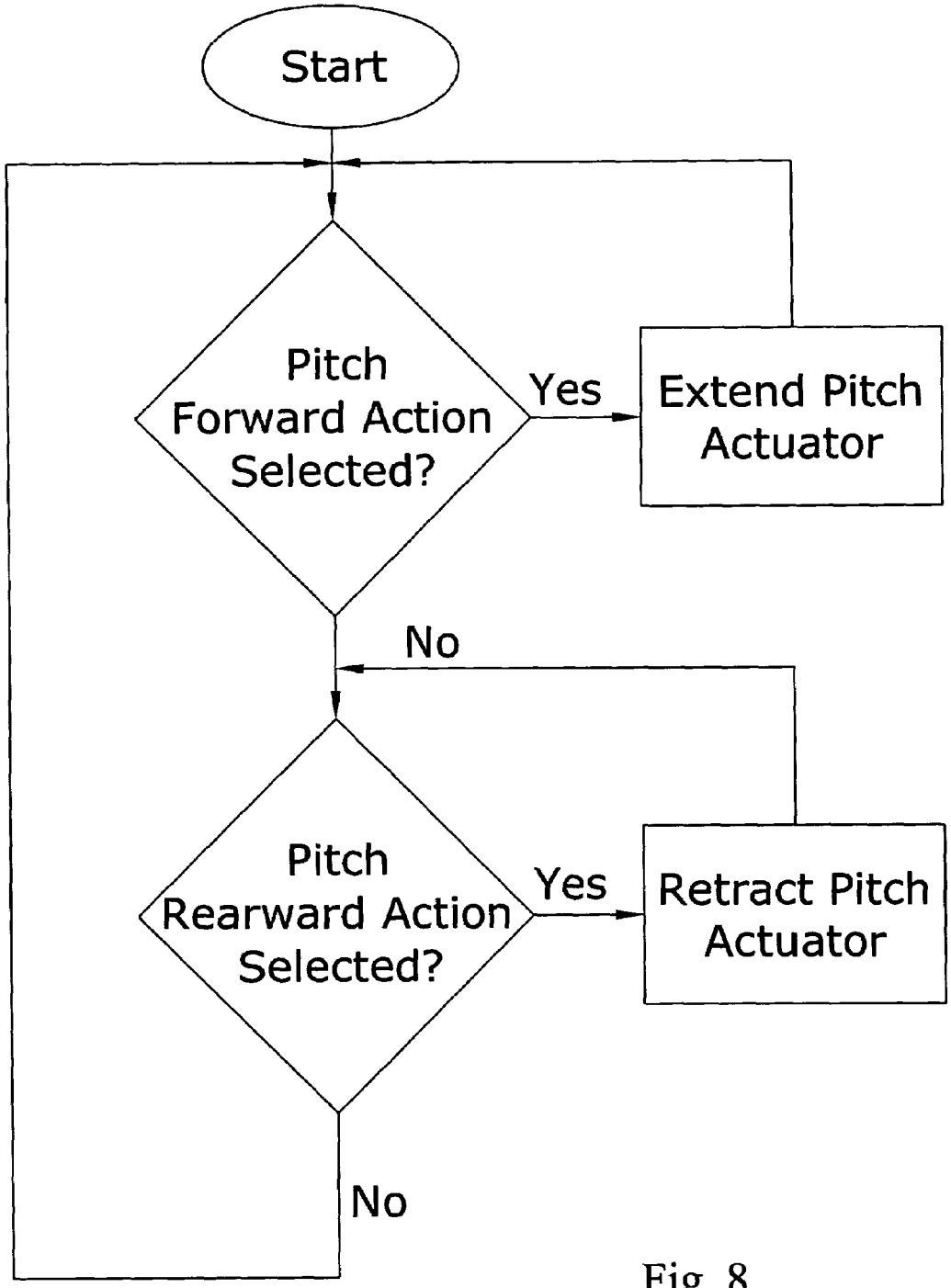
FIG. 8 is a flowchart illustrating the overall functionality of the present invention.

In operation, the control unit 40 determines whether a pitch forward condition exists or a pitch rearward condition exists as shown in FIG. 8 of the drawings. If a pitch forward condition exists, the control unit 40 causes the pitch actuator 60 to extend thereby causing the yaw actuators 70, 72 to simultaneously extend forwardly (within directly extending the yaw actuators 70, 72) thereby causing the implement structure 12 to pitch forwardly as best illustrated in FIGS. 3, 5 and 7 of the drawings.

Figure 2:
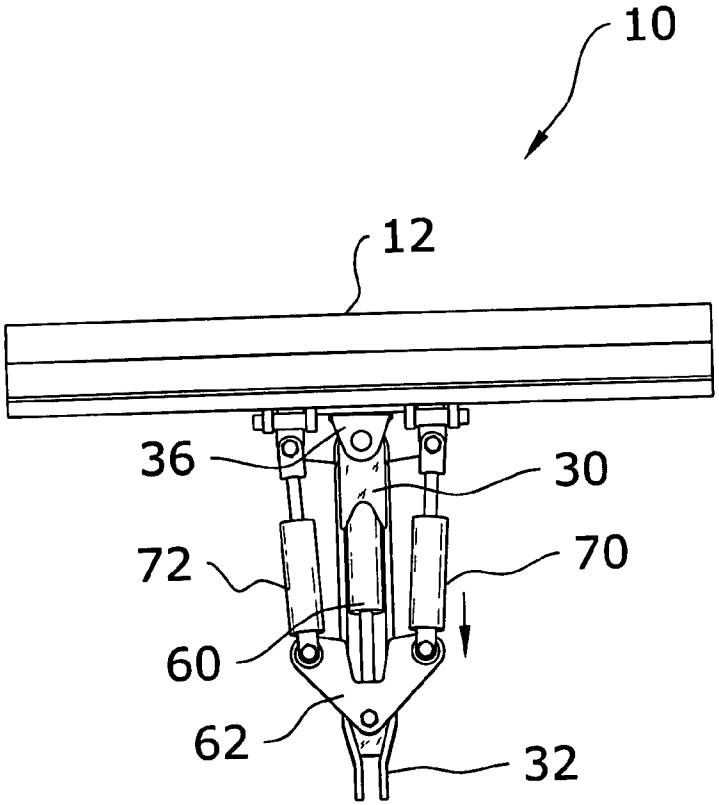
FIG. 2 is a top view of the present invention with the implement pitch rearward.

If the pitch rearward condition exists, the control unit 40 causes the pitch actuator 60 to retract thereby causing the yaw actuators 70, 72 to simultaneously retract rearwardly (within directly extending the yaw actuators 70, 72) thereby causing the implement structure 12 to pitch rearwardly as best illustrated in FIGS. 2, 4 and 6 of the drawings.

If a yaw condition exists, both of the yaw actuators 70, 72 are activated accordingly to adjust the yaw of the implement structure 12. For example, if the user desires the blade to be angled with the left side forward, the control unit 40 would cause the second yaw actuator 70 to extend and the first yaw actuator 70 to retract (and vice-versa). It can be appreciated that the adjustment of the pitch and yaw may occur simultaneously or separate. In addition, the actuators may be independently operated without fluid connection to the other actuators.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An implement pitch-yaw system, comprising:

a support structure;

an implement structure pivotally attached to said support structure;

a connecting member slidably attached to said support structure in a substantially longitudinal manner;

a first yaw actuator and a second yaw actuator attached between said implement structure and said connecting member; and a pitch actuator attached between said connecting member and said support structure for manipulating said connecting member in said substantially longitudinal manner for controlling a pitch of said implement structure.

2. The implement pitch-yaw system of claim 1, wherein said support structure is attachable to a vehicle.

3. The implement pitch-yaw system of claim 1, wherein said support structure has an elongate structure.

4. The implement pitch-yaw system of claim 3, wherein said support structure has a cavity for receiving said pitch actuator.

5. The implement pitch-yaw system of claim 3, including a slide structure slidably positioned about said support structure, wherein said connecting member is attached to said slide structure.

6. The implement pitch-yaw system of claim 1, wherein said connecting member has a winged structure, wherein said first yaw actuator and said second yaw actuator are attached to opposing portions of said connecting member.

7. The implement pitch-yaw system of claim 6, wherein said connecting member is centered along a longitudinal axis of said support structure.

8. An implement pitch-yaw system, comprising:

a support structure;

an implement structure pivotally attached to said support structure;

a connecting member slidably attached to said support structure in a substantially longitudinal manner;

a first yaw actuator and a second yaw actuator attached between said implement structure and said connecting member;

a pitch actuator attached between said connecting member and said support structure for manipulating said connecting member in said substantially longitudinal manner for controlling a pitch of said implement structure; and a control unit in communication with said first yaw actuator, said second yaw actuator and said pitch actuator for controlling the same.

9. The implement pitch-yaw system of claim 8, wherein said support structure is attachable to a vehicle.

10. The implement pitch-yaw system of claim 8, wherein said support structure has an elongate structure.

11. The implement pitch-yaw system of claim 10, wherein said support structure has a cavity for receiving said pitch actuator.

12. The implement pitch-yaw system of claim 10, including a slide structure slidably positioned about said support structure, wherein said connecting member is attached to said slide structure.

13. The implement pitch-yaw system of claim 8, wherein said connecting member has a winged structure, wherein said first yaw actuator and said second yaw actuator are attached to opposing portions of said connecting member.

14. The implement pitch-yaw system of claim 13, wherein said connecting member is centered along a longitudinal axis of said support structure.

15. A method operating an implement pitch-yaw system having a support structure, an implement structure pivotally attached to said support structure, a connecting member slidably attached to said support structure in a substantially longitudinal manner, a first yaw actuator and a second yaw actuator attached between said implement structure and said connecting member, and a pitch actuator attached between said connecting member and said support structure for manipulating said connecting member in said substantially longitudinal manner for controlling a pitch of said implement structure, said method comprising the steps of:

(a) determining whether a pitch forward condition exists;

(b) extending said pitch actuator if said pitch forward condition exists;

(c) determining whether a pitch rearward condition exists; and (d) retracting said pitch actuator if said pitch rearward condition exists.

16. The method of operating an implement pitch-yaw system of claim 15, including the following steps:

(e) determining whether a yaw condition exists; and (f) extending or retracting said first yaw actuator and said second yaw actuator if said yaw condition exists.

17. The method of operating an implement pitch-yaw system of claim 15, wherein said support structure has an elongate structure.

18. The method of operating an implement pitch-yaw system of claim 17, wherein said support structure has a cavity for receiving said pitch actuator.

19. The method of operating an implement pitch-yaw system of claim 17, including a slide structure slidably positioned about said support structure, wherein said connecting member is attached to said slide structure.

20. The method of operating an implement pitch-yaw system of claim 15, wherein said connecting member has a winged structure, wherein said first yaw actuator and said second yaw actuator are attached to opposing portions of said connecting member.

* * * * *